United States Patent [19]

de la Haye

[11] Patent Number: 4,984,612

[45] Date of Patent: Jan. 15, 1991

[54] AUTOMATIC SHUT-OFF LIQUID DELIVERY NOZZLE

[75] Inventor: Cornelis F. de la Haye, The Hague, Netherlands

[73] Assignee: Koppens Automatic Fabrieken B.V., Bladel, Netherlands

[21] Appl. No.: 337,714

[22] Filed: Apr. 13, 1989

[30] Foreign Application Priority Data

Apr. 13, 1988 [NL] Netherlands ..... 8800959

[51] Int. Cl.[5] ..... B65B 3/04

[52] U.S. Cl. ..... 141/198; 141/207; 141/217; 141/226; 141/311 R

[58] Field of Search ..... 141/198, 206, 207, 208, 141/209, 210, 211, 214, 215, 217, 219, 225, 226, 311 R, 311 A, 346, 347, 351, 352, 353, 354, 291, 292, 293, 294, 286, 301, 302, 305, 308

[56] References Cited

U.S. PATENT DOCUMENTS

| | | | |
|---|---|---|---|
| 2,083,078 | 6/1937 | Mayo | 141/209 X |
| 2,111,852 | 3/1958 | Flinchbaugh . | |
| 2,445,524 | 3/1974 | Grise . | |
| 3,513,887 | 5/1970 | Limandri | 141/207 |
| 3,796,240 | 7/1948 | Miller, Jr. . | |
| 4,011,897 | 3/1977 | Hansel | 141/207 |
| 4,031,930 | 6/1977 | Sutcliffe et al. | 141/207 |
| 4,056,131 | 11/1977 | Healy | 141/206 |
| 4,213,488 | 7/1980 | Pyle | 141/207 X |
| 4,418,730 | 12/1983 | McMath | 141/207 |
| 4,557,302 | 12/1985 | Sunderhaus | 141/207 |

*Primary Examiner*—Ernest G. Cusick

*Attorney, Agent, or Firm*—Fleit, Jacobson, Cohn, Price, Holman & Stern

[57] ABSTRACT

A delivery nozzle is connected to the outlet end of a fuel supply hose and includes an outlet pipe. A valve is operatively associated with the discharge end of the outlet pipe for opening and closing the latter and an operator is provided for closing the valve responsive to the operator being subject to sub-atmospheric pressure. Further, sub-atmospheric pressure generating structure is operatively associated with the valve operator and generates sub-atmospheric pressure responsive to fuel flow through the outlet pipe and the discharge end of the pipe being submerged within rising fuel in a tank or a tank fill neck into which fuel is being discharged from the outlet pipe.

6 Claims, 1 Drawing Sheet

AUTOMATIC SHUT-OFF LIQUID DELIVERY NOZZLE

BACKGROUND OF THE INVENTION

1. Field of the Invention

This invention relates to a delivery nozzle connected to the end of a fuel supply hose, said nozzle comprising an outlet pipe, a valve, means for operating said valve and means responsive to subatmospheric pressure for automatically closing said valve.

2. Description of Related Art

In a similar, generally known nozzle, the valve is disposed in a handle, and the means for manually operating the valve are disposed under the handle. Furthermore, an open connecting line extends through the outlet pipe, namely, from the free end of the outlet pipe to a point in the vicinity of the valve, with the result that when the relevant end of the connecting line is closed as a result of the level of the liquid in the tank being filled, a subatmospheric pressure arises at the other end disposed in the vicinity of the valve, as a result of which the valve is closed.

Such a known device has various disadvantages, the first of which is that there is always after-drip as a result of the fact that the valve is spaced from the outlet pipe end. A further disadvantage is that the valve is operated by hand, and so can easily be opened before the outlet pipe end is within the tank to be filled. A third drawback is that the valve construction is such that in the vicinity of the valve the fluid being supplied is greatly whirled in the nozzle, resulting in a certain degree of foaming which is apt to cause premature closure of the means responsive to subatmospheric pressure for closing the valve.

SUMMARY OF THE INVENTION

It is an object of the present invention to remove the above drawbacks and disadvantages.

To this effect, according to the invention, the fuelling gun is in the first place characterized in that the valve is disposed at the free end of the outlet pipe, whereby after-drip is prevented.

Furthermore, the outlet pipe may be connected to the supply hose end by means of a first bellows, while further releasable means are provided on the outside of said outlet pipe for keeping said first bellows in an extended position. In this way, when the outlet pipe is inserted into the filling hole, the releasable means can be operated, whereby subsequently the bellows can be compressed as the outlet pipe is inserted farther into the filling hole.

In a further elaboration of the present invention, the valve may be fixedly connected through a tube member extending through said outlet pipe to one end of a second bellows, disposed within said first bellows, the other, closed end of which second bellows is fixedly connected to the supply hose end.

In a further preferred embodiment, the nozzle is provided with an open connecting line within the tube member, which connecting line terminates at one end in the second bellows, and at the other end laterally of the outer surface of the valve. By virtue of this arrangement, an automatic closure of the outlet opening between the valve and the relevant outlet pipe end can be obtained.

In yet another preferred embodiment, the first bellows is connected to the supply hose at a point spaced from the end of said supply hose and in sealing relationship therewith, and the supply hose portion extending within the bellows is provided at its circumference with one or more fluid passages, and furthermore, the end of the outlet pipe extending within the first bellows is laterally provided with one or more fluid passages. There is thus provided a flow path for the fluid between the supply hose and the outlet end of the outlet pipe.

The nozzle according to the present invention as described above, is hand-operated and self-closing;

contains detection means for detecting the presence of the outlet pipe in a filling hole;

contains few, if any, movable mechanisms;

its valve is not operated by a lever mechanism to be squeezed;

there is no foaming within the nozzle, while there can be no after-drip.

Some embodiments of the nozzle according to the present invention will now be described, by way of example, with reference to the accompanying drawings.

DESCRIPTION OF THE PREFERRED EMBODIMENTS

Figures 1, 2, 3, 4, 5:
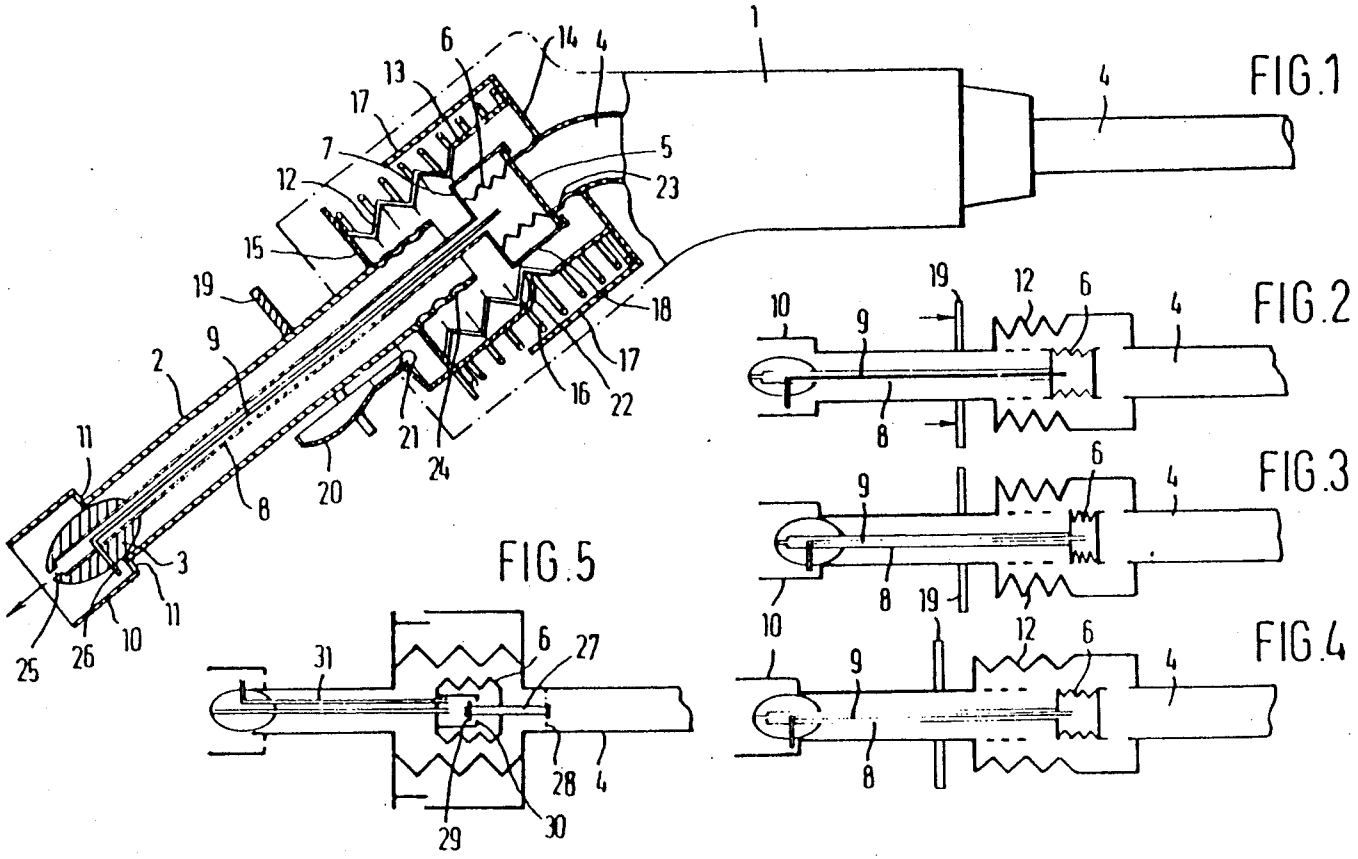
FIG. 1 is a side elevational view of a nozzle constructed in accordance with the present invention and with portions of the nozzle broken away and illustrated in vertical section.
FIG. 2 is a schematic view of the nozzle with the internal parts thereof in fuel delivery positions.
FIG. 3 is a schematic view of the nozzle with the internal parts thereof in initial fuel flow terminating positions as a result of fuel rising to the nozzle in the fill neck of an associated fuel receptacle.
FIG. 4 is a schematic view of the nozzle with the internal parts thereof in final fuel flow terminating positions.
FIG. 5 is a schematic view similar to FIG. 4 but illustrating a modified form of the invention.

Referring to the drawings, and in particular FIG. 1, the nozzle according to the present invention comprises a housing 1, an outlet pipe or elongated spout portion 2, and a valve 3. Furthermore, the discharge end of a fuel supply tube 4 terminates within the housing 1. This the discharge end is closed with a disc 5. Connected to disc 5 is one end of a bellows 6, the other end of which is closed by a disc 7. Connected to the front end of disc 7, in open communication with the interior of bellows 6 is one end of a tube member 8, the other end of which is fixedly connected to valve 3, and extends up to the front end 25 thereof, the disc 5, bellows 6, disc 7 and tube member 8 comprising mounting means mounting the valve 3 from the fuel supply tube 4. The fuel supply tube 4 comprises the inlet end of a fuel flow passage extending through the nozzle and having the outlet pipe or spout portion 2 as its outlet end. Extending through tube member 8 is an open connecting line 9, one end of which terminates within bellows 6, while the other end 26 terminates laterally outwardly of the outer surface of valve 3. In order to prevent this projecting end from being damaged, a protective ring 10 is provided, which is connected to outlet pipe 2 by means of brackets 11.

Provided outwardly of bellows 6 is a bellows 12, one end of which is fixedly connected through an annular member 13 and a flat ring 14 to the supply hose or tube discharge end 4. The other end of bellows 12 is fixedly connected through an annular disc 15 to the outlet pipe 2. Provided between outwardly extended portions of ring 14 and disc 15 is a helical compression spring 16 which provides for an extension or stretching of bellows 12. This helical spring is covered by a shell 17 which also serves as a stop for the compression of spring 16 and bellows 12, the bellows 12, annular member 13, ring 14, annular disc 15 and compression spring 16 comprising mounting means mounting the elongated spout portion 2 from the fuel supply tube 4.

Bellows 6 is also provided with a stop: in this case, hook-shaped members 18 are provided at the rim portion of disc 7, which members 18 are arranged to cooperate with the outwardly extended portion of disc 5 to limit extension of bellows 6.

As shown in FIG. 1, a bumper plate 19 is provided on outlet pipe 2. Extending through a slot in the bumper plate is a lever 20, which is pivotable about a pivot 21 fixedly connected to outlet pipe 2. The end 22 of lever 20 remote from bumper plate 19 is arranged to cooperate with bellows 12 so that, in the inoperative position of the nozzle, bellows 12 is maintained in its extended position.

Between disc 5 and ring 14, the discharge end of supply hose 4 is provided with passages 23. Similarly, the end of outlet pipe 2 extending within bellows 12 is provided with passages 24.

Taking the above into consideration and referring to FIG. 1 and the schematic FIGS. 2, 3 and 4, on a reduced scale, the operation of the device will be clear:

FIG. 1 shows the inoperative position of the device;

FIG. 2 shows a position in which the outlet pipe 2 has been inserted into a filling pipe of a fuel tank (not shown) and in which, after the actuation of lever 20, by pushing against bumper plate 19, the outlet pipe 2 has been pushed inwardly, thereby compressing spring 16 and bellows 12. As a consequence, liquid flows from the supply hose end through passages 23, the space within bellows 12 and passages 24 to the outlet pipe 2, the valve 3 being shown in the open position.

During the discharge of liquid from outlet pipe 2 about the front 25 of valve 3, a venturi effect will occur in tube member 8 adjacent to the front 3 of the valve 25: as a consequence of the presence of the open connecting line 9, however, this will have no consequences.

When the tank is getting full and the fuel level rises therein, however, the open connecting line 9 is closed at 26 by the rising fuel and a subatmospheric pressure is generated in bellows 6 to contract the latter with the result that valve 3 closes the outlet pipe 2 (FIG. 3).

Thereafter, under the influence of the pressure of the fuel present within the supply hose end, bellows 12 (comprising force generating means), outlet pipe or elongated spout portion 2 and spring 16 will be returned to their starting positions (FIG. 4).

It will be clear that a large number of modifications are possible without departing from the scope of the inventive concept.

Thus, for example, instead of helical spring 16, use can be made of a resiliently elastic bellows 12. Similarly, all sorts of alternatives can be conceived of for the various parts. For example reference is made to the construction shown diagrammatically in FIG. 5 from which, relative to FIG. 1, as in FIGS. 2–4, the obvious, largely similar parts have been omitted. The construction shown in FIG. 5 differs from the construction described hereinbefore in that the second bellows 6 is not fixedly connected to the supply hose discharge end, but arranged for limited movement within the first bellows. This restricted movability is accomplished by using a rod 27, one end of which is fixedly connected to the supply hose end 4 by means of arms 28, while the other end of rod 27 is slidingly received in the second bellows 6 and is provided with a stop 29. Stop 29 cooperates with stop arms 30 connected to the end of the second bellows remote from rod 27. A further structural modification is that the connecting line 9 in FIG. 1–4 is no longer housed within the tube member (8 in FIGS. 1–4) fixedly connected to the valve 3, but extends through outlet pipe 2 as a separate conduit 31.

I claim:

1. A nozzle, a fuel supply hose having an outlet end connected to said nozzle, said nozzle including an outlet pipe having a free discharge end and an inlet end, a valve, means for operating said valve, means responsive to sub-atmospheric pressure for automatically closing said valve, said valve being disposed at the free discharge end of said outlet pipe, said inlet end of said outlet pipe being connected to the supply hose by means of a first bellows shiftable between extended and collapsed positions, releasable means on the outside of said outlet pipe for maintaining said first bellows in said extended position.

2. The nozzle of claim 1 including a second bellows disposed within said first bellows and having a first closed end supported from said fuel supply hose and a second closed end facing downstream toward said free discharge end, a tube member extending through said outlet pipe and having a first end opening into and supported from said second end and a second end from which said valve is supported.

3. The nozzle of claim 2 including an open connecting line provided within said tube member and extending through the valve to the front end thereof, said connecting line having one end opening into said second bellows and a second end opening laterally outwardly of said valve.

4. The nozzle of claim 3 wherein said supply hose outlet end includes a terminal end, first bellows being connected to the supply hose outlet end at a point spaced from said terminal end thereof in sealed relationship therewith, said supply hose, intermediate said terminal end and said point, being provided at its circumference with at least one fluid passage therethrough.

5. The nozzle of claim 4 wherein said inlet end of said outlet pipe is disposed within said first bellows and is provided with at least one lateral fluid passage.

6. A fuel delivery nozzle defining a fuel flow passage therethrough including inlet and outlet ends with said outlet end being defined by an elongated spout portion having inlet and outlet ends, a fuel supply hose connected to said fuel flow passage inlet end, first mounting means mounting said elongated spout portion from said fuel flow passage inlet end for limited shifting between extended and retracted positions relative thereto, said spout portion including abutment means thereon intermediate the inlet and outlet ends thereof for abutting engagement with a tank fill neck into which said spout portion outlet end is telescoped, a valve, second mounting means stationarily mounting said valve from said inlet end of said fuel flow passage with said valve operatively associated with said spout portion outlet end to open and close said fuel flow passage responsive to shifting of said spout portion to said retracted and extended positions, respectively, said second mounting means mounting said valve for shifting relative to said inlet end of said fuel flow passage between downstream and upstream shifted positions, and thus also shifting relative to said spout portion, said valve, when in said downstream and upstream positions and when said spout portion is in said retracted position, being open and closed, respectively, said second mounting means including means for shifting said valve to said upstream position during fuel flow through said passage, responsive to said spout portion, downstream from said abutment means, being submerged in liquid, and said first mounting means, when said spout portion is in said retracted position and said valve is in said upstream position, including force generating means, responsive to said inlet end of said fuel flow passage being subject to liquid under pressure from said supply hose, operative to forcibly shift said spout portion to said extended position while said valve is in said closed position and therefore also operative to shift said valve to said downstream position.

* * * * *